US006805584B1

(12) United States Patent
Chen

(10) Patent No.: US 6,805,584 B1
(45) Date of Patent: Oct. 19, 2004

(54) SIGNAL ADAPTOR

(76) Inventor: Chiung-Ling Chen, 6F, No. 55, Chang-Hsin Street, Wen-Shan District, Taipei City (TW)

( * ) Notice: Subject to any disclaimer, the term of this patent is extended or adjusted under 35 U.S.C. 154(b) by 0 days.

(21) Appl. No.: 10/626,705

(22) Filed: Jul. 25, 2003

(51) Int. Cl.[7] ..... H01R 9/05
(52) U.S. Cl. ..... 439/578; 439/587
(58) Field of Search ..... 439/578, 580, 439/582, 583, 584, 585, 587, 588, 589, 275, 279

(56) References Cited

U.S. PATENT DOCUMENTS 5,340,332 A * 8/1994 Nakajima et al. ..... 439/584
5,571,028 A * 11/1996 Szegda ..... 439/322
5,975,949 A * 11/1999 Holliday et al. ..... 439/585
6,331,123 B1 * 12/2001 Rodrigues ..... 439/584
6,425,782 B1 * 7/2002 Holland ..... 439/585
6,634,906 B1 * 10/2003 Yeh ..... 439/585
6,733,336 B1 * 5/2004 Montena et al. ..... 439/578
6,733,338 B1 * 5/2004 Hsia ..... 439/578

* cited by examiner

*Primary Examiner*—Ross Gushi
(74) *Attorney, Agent, or Firm*—Rabin & Berdo, P.C.

(57) ABSTRACT

A signal adaptor having waterproof capability is provided. A pad is positioned around the conjunctive portion at one end of the tubing element such that when fitting the tubing element and the fastening tube together forming the joint portion of the nut, the pad around the conjunctive portion seals the frontal and rear end of the signal adaptor providing waterproof effect. And the other end of the tubing element is fitted within the positioning tube where tubing element is held and fastened securely.

7 Claims, 10 Drawing Sheets

SIGNAL ADAPTOR

BACKGROUND OF THE INVENTION

1. The Field of the Invention

The present invention is generally related to a signal adaptor, and more particularly, to a signal adaptor comprising a nut whose frontal and rear ends are sealed so that humidity leakage into the signal adaptor can be effectively avoided and thereby interferences resulting from humidity leakage can be effectively eliminated. Thus, the quality of the signal transmission within the signal adaptor can be effectively promoted.

2. Description of the Related Art

Presently available signal adaptor comprises a main body for connecting to a circular thin tube for receiving the signal wire therewithin. A hand tool is required to directly press onto the outer part of the thin tube in order to deform the outer part of the thin tube while forcing the signal wire into the main body where the signal wire is being held therewithin. However, such forced deformation could only clamp the signal wire into a fixed position. Besides a vertical joint gap is inevitably formed in the thin tube. Further, while forcing the thin tube into the main body of the signal adaptor with an aid of the hand tool, there is a potential risk of cracking the thin tube thereby causing a bad contact of the inner conductor or the signal wire gets easily dislodged when accidentally pulled or shook by the external force. Thus the signal wire cannot be reliably housed and positioned within the thin tube. For improving the above conventional signal adaptor, some of the manufacturers have developed a tube fastening method to joint the signal wire to the signal adaptor, such as a distal adaptor for synchro-axle cable as shown in FIGS. 8 and 9. Some of the advantages of this signal adapter are as follows.

A movable outer tube A tubing covers the tube B and is concentrically position with the extending portion B1 of the tube B. A circular hollow space is formed between the outer tube A and the extending portion B1. Additionally, the extending portion A1 formed at the rear side of the outer tube A has a smooth outer sidewall A2. A tubing element C covers the extending portion A1 at the rear side of the outer tube A with an axial oriented awl shaped aperture C1.

The conventional signal adapter mentioned above uses the outer tube A to cover the tube B, and a tubing element C covers around the extending portion A1 at the rear side of the outer tube A. The axial oriented awl shaped aperture C1 presses the tubing element C and the extending portion A1 at the rear side of the outer tube A for pressing and fastening purpose where the forced deformation of the extending portion A1 is used to press onto the signal wire D for contacting the adaptor E. However, there are some defects from using the axial oriented awl shaped aperture C1 to press the tubing element C and the extending portion A1 at the rear side of the outer tube A. The defects of the above design are:

1. Because the axial oriented awl shaped aperture C1 presses against the tubing element C and the extending portion A1 at the rear side of the outer tube A for holding and positioning, the tubing element C could become loose and gets dislodged from the outer tube A easily as the signal wire D is bent or pulled during installation.

2. As the tubing element C and outer tube A are both made of metallic material, the contact surfaces of these two elements are hard and non-elastic, and therefore a correspondingly tight frictional joint is required for setting, and such setting procedure is troublesome and inconvenient.

3. When the tubing element C is used for covering around the outer tube A, the outer dimension of the tubing element C must be larger than the outer tube A, and also correspondingly larger than the adaptor E to barricade the adaptor E, thus when plugging the adaptor E into the socket, the barricade formed by the tubing element C will be extremely difficult for plugging the adaptor E.

4. Even after connecting the signal wire D with the adaptor E, the humidity could seep into the gap during the jointing process to adversely affect the signal transmission quality of the signal wire D.

It is critical that no humidity seeps within the signal adaptor as humidity within the signal adaptor could adversely affect the signal transmission quality due to interferences. Accordingly, it is important the signal adaptor should have waterproof capability so that the humidity can be prevented from seeping into the signal adaptor. Generally, the signal wire is cut or trimmed, in doing so, a slight flat portion at the cut end will be formed, in other words, the cut end cannot be a perfect rounded shape and thus making insertion or sliding of the signal wire into the adaptor more difficult. Further, because the tubing element and outer tube are both made of metallic material, the contact surfaces of these two objects are hard and without elasticity to contain the deformed signal wire, and the difficulty of sliding the signal wire into the tube is obvious. Additionally, if the signal wire is bent or twisted, sliding or insertion of such twisted or bent into the tube is difficult. Accordingly, it is highly desirable to improve the signal adaptor to resolve the defects of the conventional art.

SUMMARY OF THE INVENTION

Accordingly, in the view of the foregoing, the present inventor makes a detailed study of related art to evaluate and consider, and uses years of accumulated experience in this field, and through several experiments, to create a new signal adaptor having waterproof capability.

According to one aspect of the present invention, a tubing element is inserted within a nut forming a joint portion at one distal end thereof, and a pad is disposed between the joint portion and the nut such that the pad fits tightly against inner sidewalls of the nut and the outer sidewall of the tubing element tightly, thereby sealing the frontal and rear ends of the nut joint providing the waterproof effect. The other end of the tubing element is covered with a connecting portion, and further the connecting portion is covered with the positioning tube. The positioning tube comprises a receiving chamber, wherein the receiving chamber has a positioning ring at one end a securing element at the other end, wherein the securing element is formed as an integral unit with positioning tube. The elastic property of the positioning tube enables the positioning tube to cover onto the tubing element tightly.

According to another aspect of the present invention, a plurality of inner buckles are formed within the central aperture of the tubing element, so that when the signal wire is inserted into the tubing element and the positioning tube is pushed to cover the tubing element, and making the inner buckles press against at the isolation layer of the wire. Thus the positioning tube can be secured onto the tubing element and the signal wire can be secured within the central aperture of the tubing element and cannot be easily dislodged by any accidental external force.

According to another aspect of the present invention, a circular groove is disposed on the conjunctive portion of the tubing element and a pad is placed within the circular groove for sealing the gap between the tubing element and the nut rendering both the frontal end and the rear end of the cut joint waterproof.

According to another aspect of the present invention, the buckling element of the connecting portion is held within the positioning tube as the signal wire is pushed upwards within the tubing element. Thus the connecting portion can effectively cover the tubing element and is secured by the tubing element.

BRIEF DESCRIPTION OF THE DRAWING

For a more complete understanding of the present invention, reference will now be made to the following detailed description of preferred embodiments taken in conjunction with the accompanying drawings, in which.

DETAILED DESCRIPTION OF PREFERRED EMBODIMENTS

Figure 1:
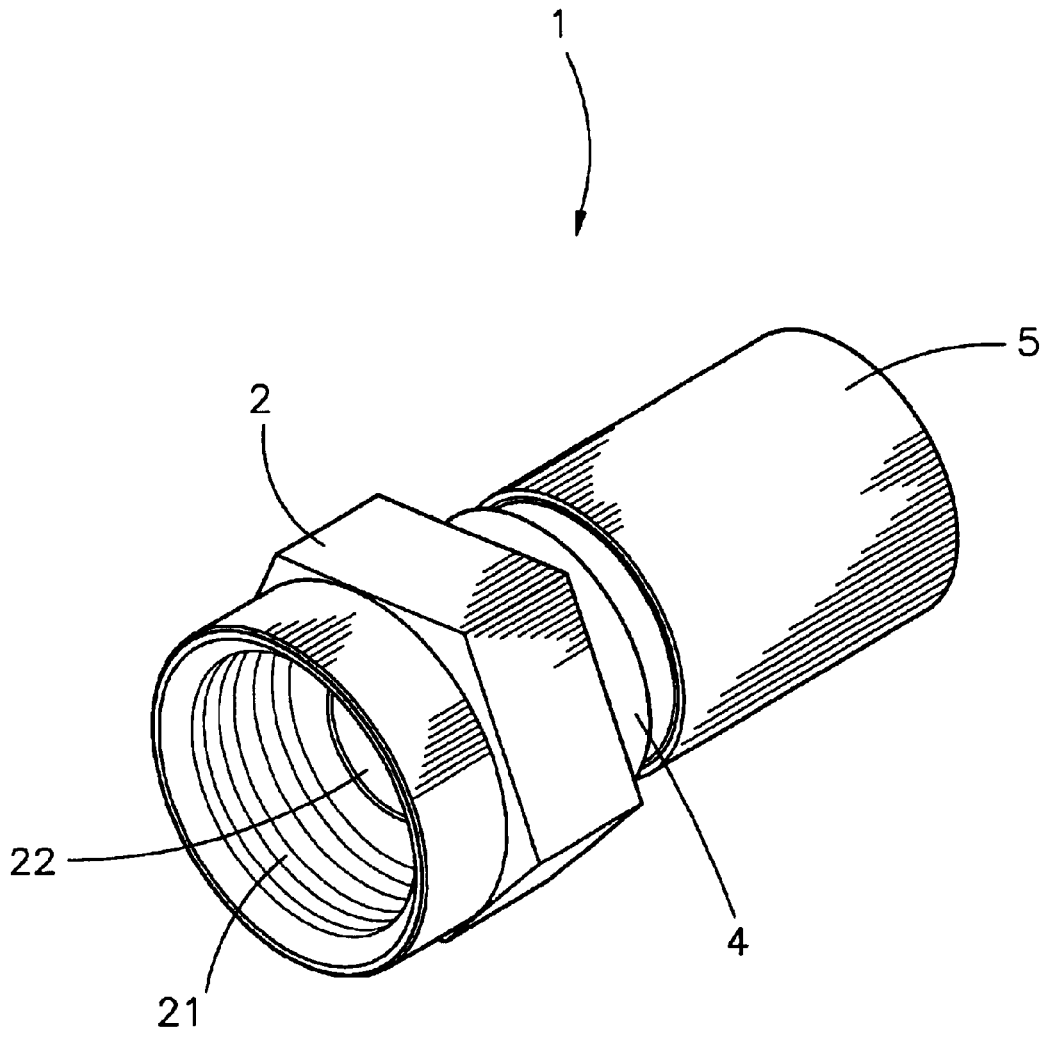
FIG. 1 is the elevational view of a signal adaptor of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
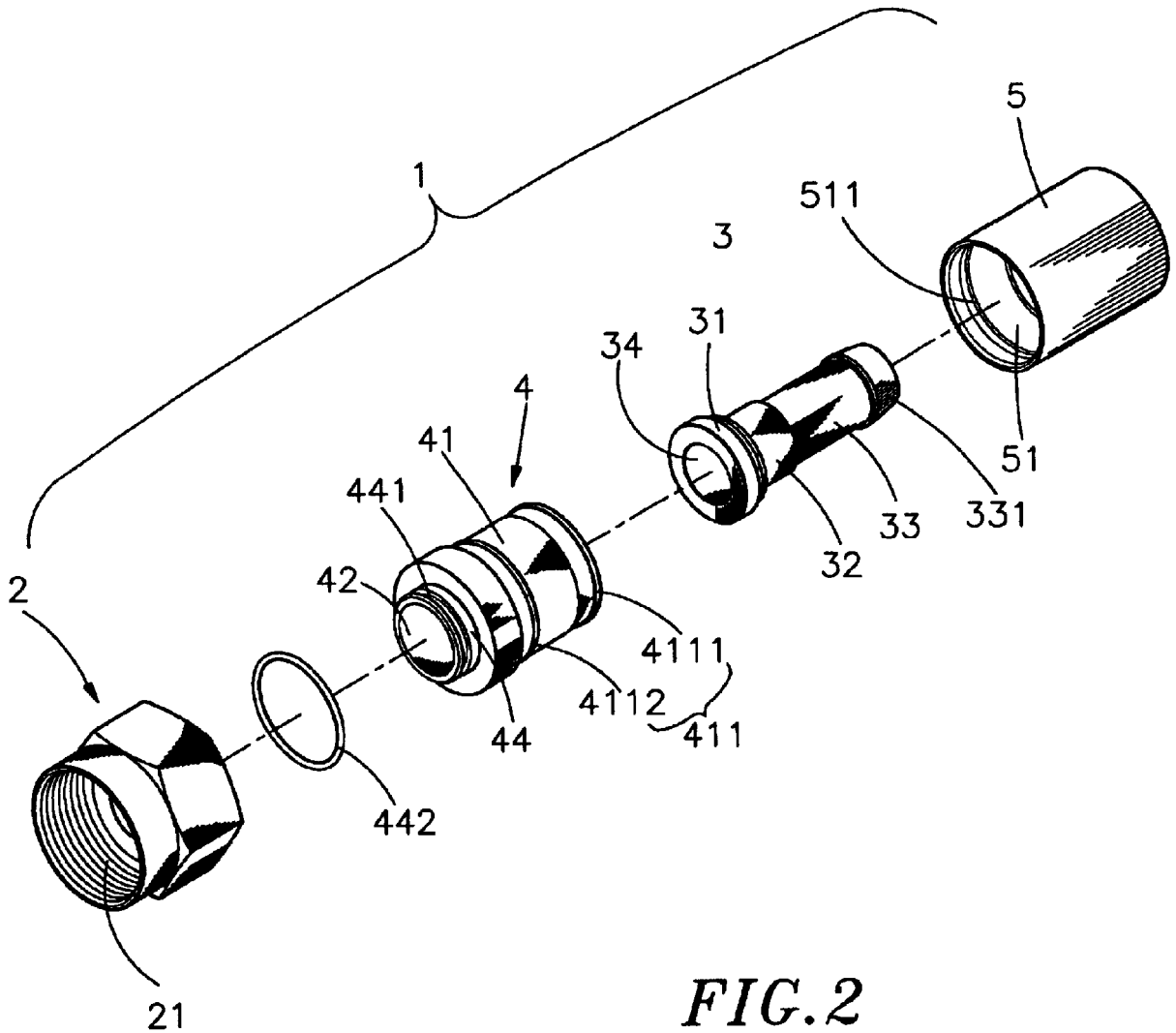
FIG. 2 is an exploded view of the signal adaptor of the present invention.
Figure 3:
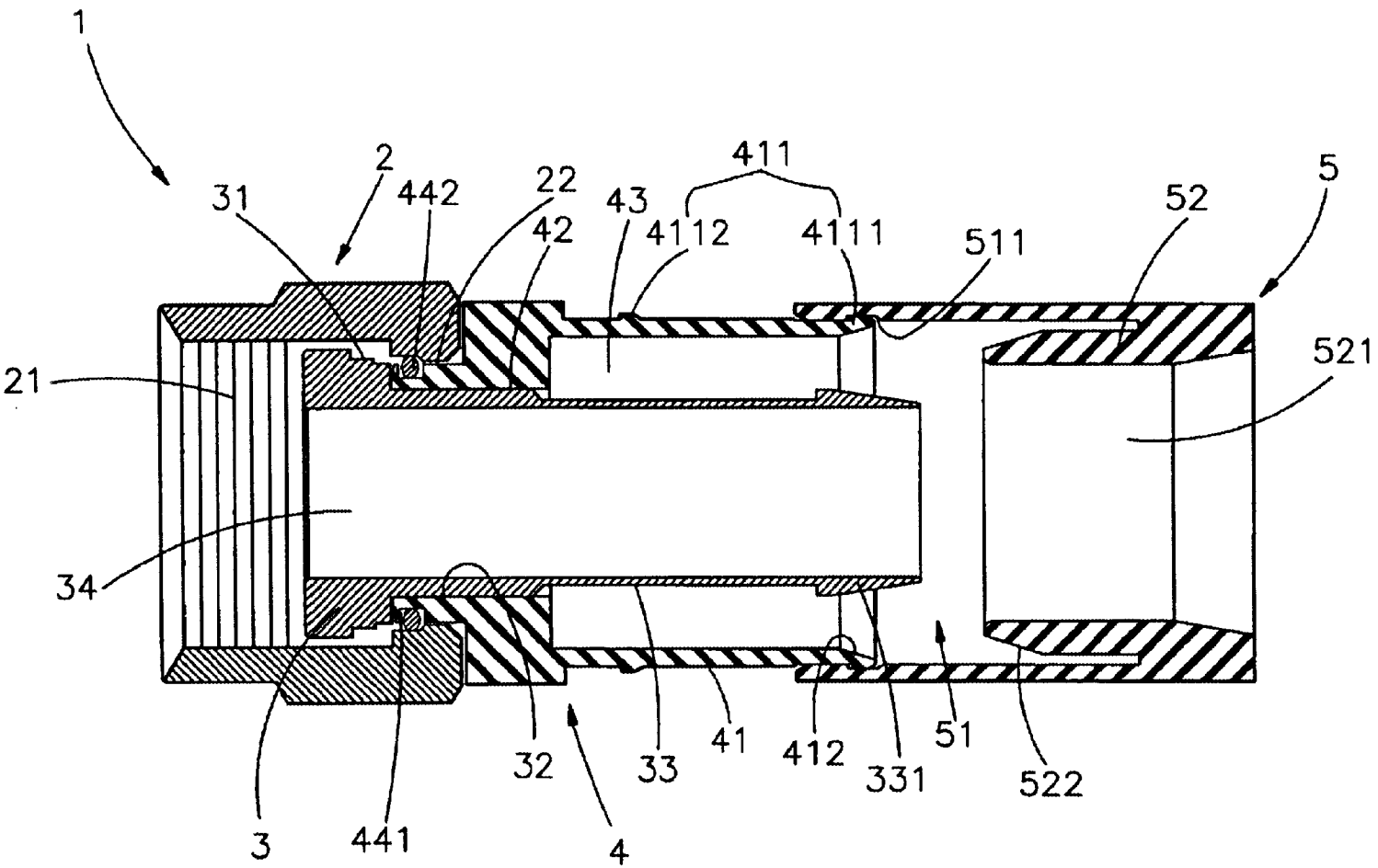
FIG. 3 is a sectional side view of the signal adaptor of the present invention.

Referring to FIGS. 1, 2 and 3, show an elevational view, an exploded view and a sectional side view of the signal adaptor of the present invention. The adaptor 1 of the present invention comprises a nut 2, a fastening tube 3, a tubing element 4 and a positioning tube 5.

The nut 2 has inner treading 21 and a joint portion 22 at one end.

The fastening tube 3 has a supporting portion 31 at on end and a tubing portion 32 at the other end. The tubing portion 32 has a tube 33 at the rear side. The distal end of the tube 33 is configured into an inclined awl shaped buckling portion 331. Additionally, a buckling groove 34 is formed in the fastening tube 3.

The tubing element 4 comprises a conjunctive portion 44 at the frontal end, the conjunctive portion 44 has a receiving circular groove 441 at the outer flange thereof The conjunctive portion 44 comprises a receiving hole 42, and the rear end of the receiving hole 42 is comprised of a covering hole 43 with larger dimension. Additionally, the outer portion of the tubing element 4 has a connecting portion 41. A bucking element 411 is disposed on the connecting portion 41, wherein the bucking element 411 comprises a fixing ring 4111 and a buckling ring 4112.

The positioning tube 5 comprises a receiving chamber 51, and the inner sidewall of the receiving chamber 51 has a positioning ring 511. A securing element 52 is disposed at one end of the receiving chamber 51, wherein the securing element 52 is integrally formed with the positioning tube 5. The securing element 52 comprises a central aperture 521, wherein the outer flange of the securing element 52 is configured into an outer sloping face 522.

Figure 4:
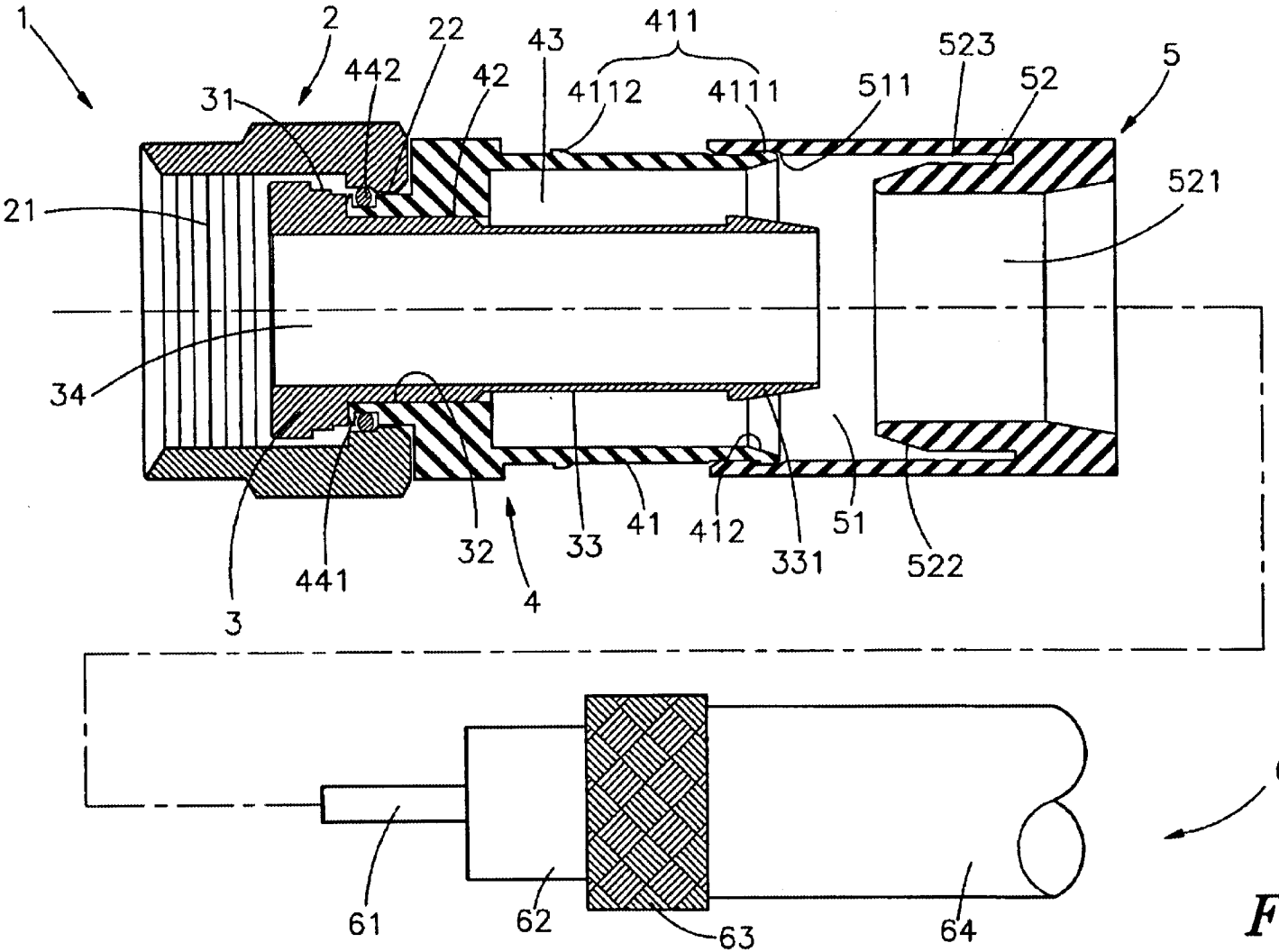
FIG. 4 is a sectional exploded view of the signal adaptor of the present invention.
Figure 5:
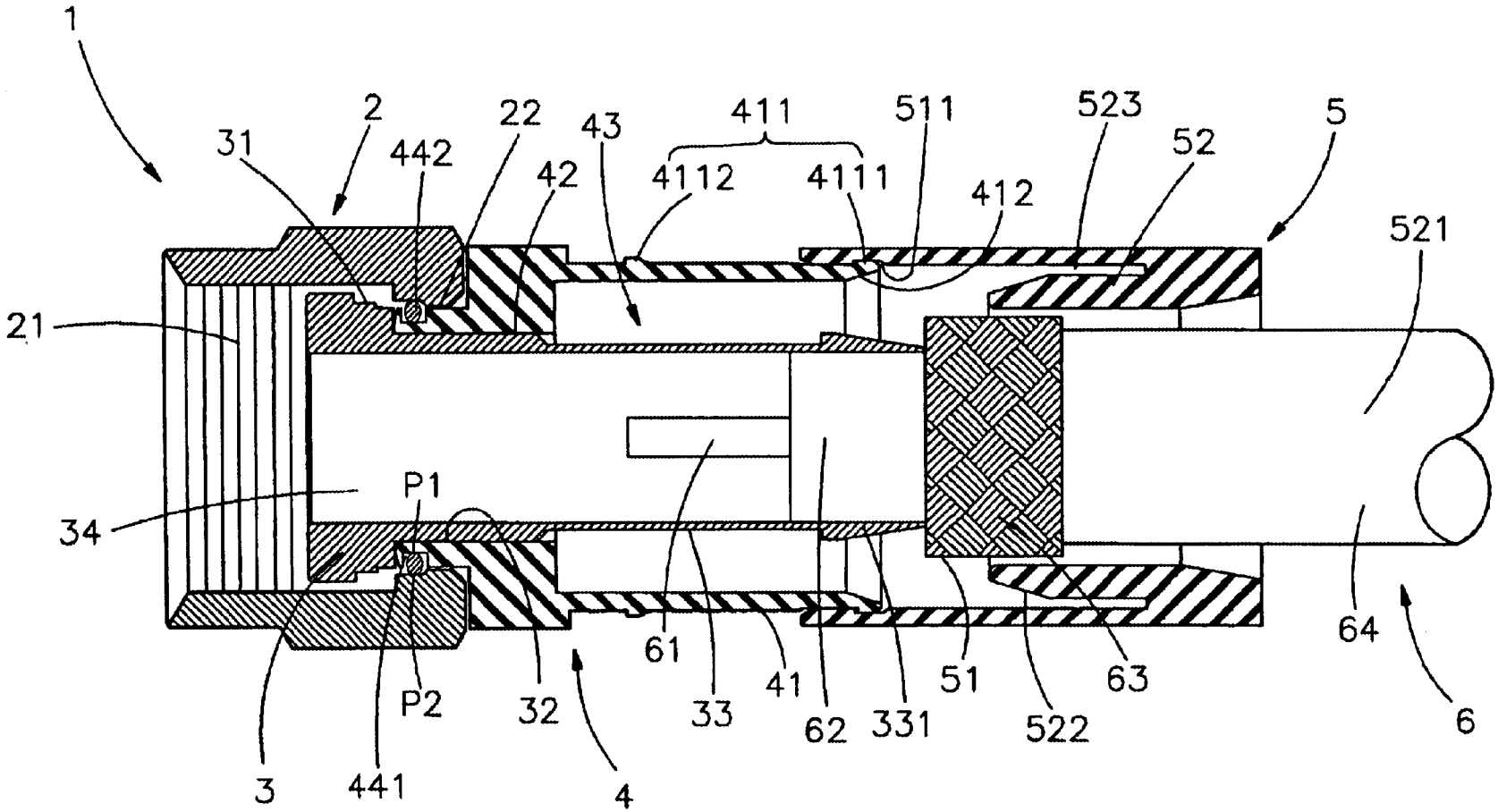
FIG. 5 is a sectional view showing before connecting the signal adaptor of the present invention with the connecting element.
Figure 6:
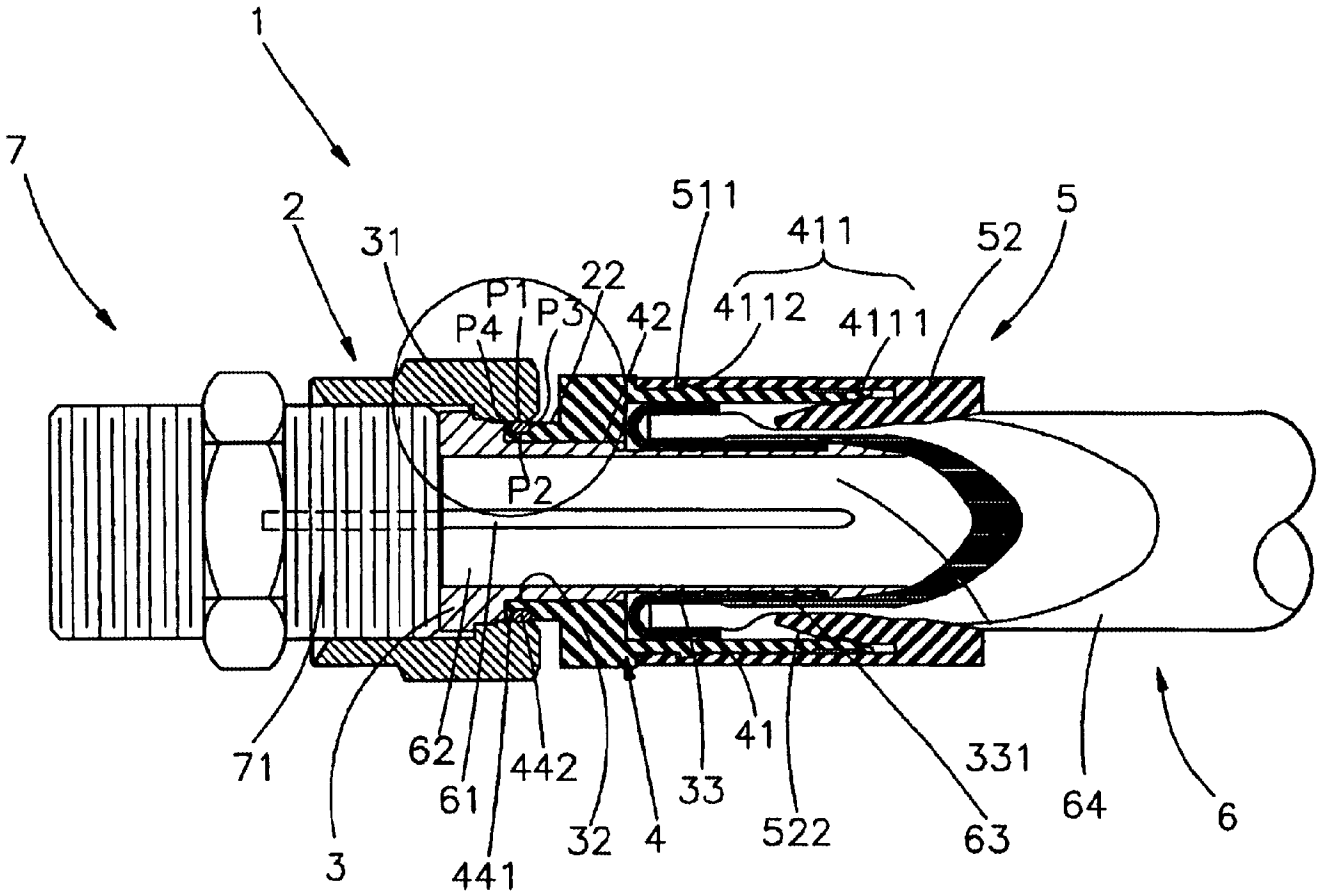
FIG. 6 is the sectional view showing after connecting the signal adaptor of the present invention with the connecting element.
Figure 6A:
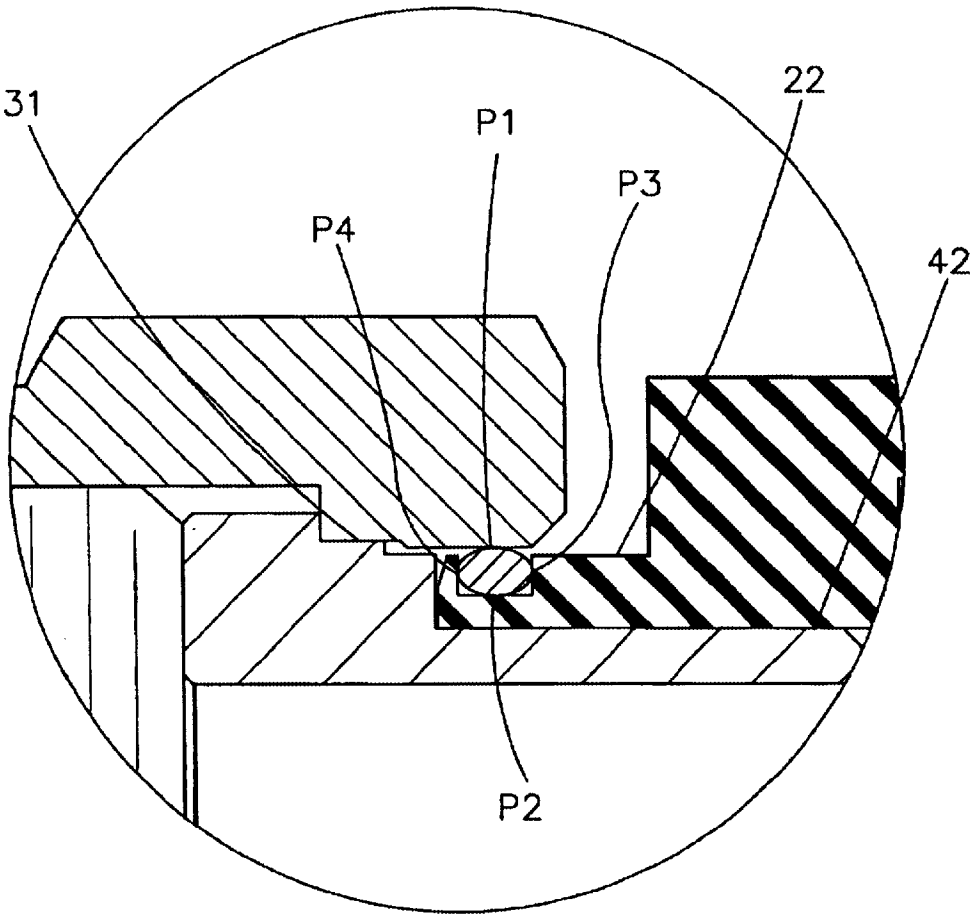
FIG. 6A is a partial zoom out of the FIG. 6.

The assembling procedure of the various elements of the signal adaptor mentioned above is described as follows. First, the fastening tube 3 is fitted into the nut 2. Now, referring to FIG. 4, as shown, after fitting the fastening tube 3 into the nut 2, the tubing portion 32 and the tube 33 extend out from the rear side of the nut 2. The supporting portion 31 of the fastening tube 3 is supported within the joint portion 22 of the nut 2. Next, the tubing element 4 is fitted onto the fastening tube 3 such that the tubing element 4 securely fits around the tubing portion 32 within the receiving hole 42. Next, the positioning tube 5 is fitted into the connecting portion 41 of the tubing element 4, wherein the positioning ring 511 of the receiving chamber 51 of the positioning tube 5 engages with the fixing ring 4111 of the buckling mechanism 411 of the connecting portion 41. After fitting the receiving circular groove 441 into the pad 442, the conjunctive portion 44 of the tubing element 4 and the pad 442 are securely positioned within the tubing portion 31 of the fastening tube 3. A surface contact point P1 is formed between the pad 442 and the receiving circular groove 441, and another surface contact point n is formed between the pad 442 and the joint portion 22 of the nut 2. Referring to FIG. 5, the conjunctive portion 44 and the tubing portion 32 forms the joint portion 22 of the nut 2 with the pad 442 in the receiving circular groove 441 of the tubing element 4 securing the tubing portion 32 at multiple contact points P1, P2, P3 and P4 for jointing and sealing the fastening tube 3 and the tubing element 4 tightly with the nut 2. Referring to FIGS. 6 and 6A now, show the frontal and rear ends of the nut 2 after assembly will be thus covered and sealed tightly to achieve waterproof effect, which is the primary feature of the signal adaptor 1.

Referring to FIGS. 5, 6 and 6A, before connecting the signal adaptor 1 to the signal wire 6, the conductive wire 61, isolation layer 62 and the metallic wiring layer 63 of the signal wire 6 are exposed out of the sheath 64. To fit the signal wire 6 into the positioning tube 5 of the signal adaptor 1, the signal wire 6 is pushed into the central aperture 521 of the positioning tube 5 so that the positioning ring 511 within the receiving chamber 51 of the positioning tube 5 leaves the fixing ring 4111 and move to buckle with the buckling ring 4112. The signal wire 6 is continued to be pushed into the positioning tube 5 through the receiving chamber 51 into the tube 33 of the fastening tube 3 until the conductive wire 61 and the isolation layer 62 penetrate through the buckling groove 34 of the fastening tube 3 making the conductive wire 61 to slightly protrude out of the nut 2.

Additionally, the metallic wiring layer 63 and isolation layer 62 covers the outer portions of the fastening tube 3 and are clamped by the covering hole 43 of the tubing element 4. Thus the metallic wiring layer 63 and isolation layer 62 are held between the fastening tube 3 and the tubing element 4. While pushing the positioning tube 5, the securing element 52 within is moved along with the positioning tube 5 as well, and when the outer slopping face 522 of the securing element 52 supports on the slopping face 412 of the tubing element 4, the outer slopping face 522 is pressed towards the central portion and pushes the sheath 64 outside for securely champing the signal wire 6 within the positioning tube 5. Thus the positioning tube 5 can be held firmly within the tubing element 4 even when the signal wire 6 is being accidentally pulled through an external force.

The pad 442 is disposed at one end of the conjunctive portion 44 of the tubing element 4, after fitting the tubing element 4 onto the fastening tube 3, the tubing element 4 together with the fastening tube 3 form the joint portion 22 of the nut 2, and through the clamping and pressing forces of the pad 442, conjunctive portion 44, the tubing portion 32 of the fastening tube 3 and the joint portion 22, multiple contact points P1, P2, P3 and P4 between the pad 442 and joint portion 22 are created sealing the frontal and rear end of the nut 2 which in turn provides the best waterproof effect. The pad 442 is capable of blocking the humidity to seep in from the joint part of the rear end of the nut 2 and the tubing element 4, thus the humidity can be effectively prevented from entering into the nut 2. Additionally, the supporting portion 31 of the fastening tube 3 within the nut 2 is positioned against the inner sidewall of the joint portion 22, when the inner threading 21 of the nut 2 joints with the connecting portion 71 of the connecting element 7, the connecting portion 71 pushes the supporting portion 31 of the fastening tube 3 to seal the supporting portion 31 and the joint portion 22 to effectively seal the frontal end of the nut 2.

Figure 7:
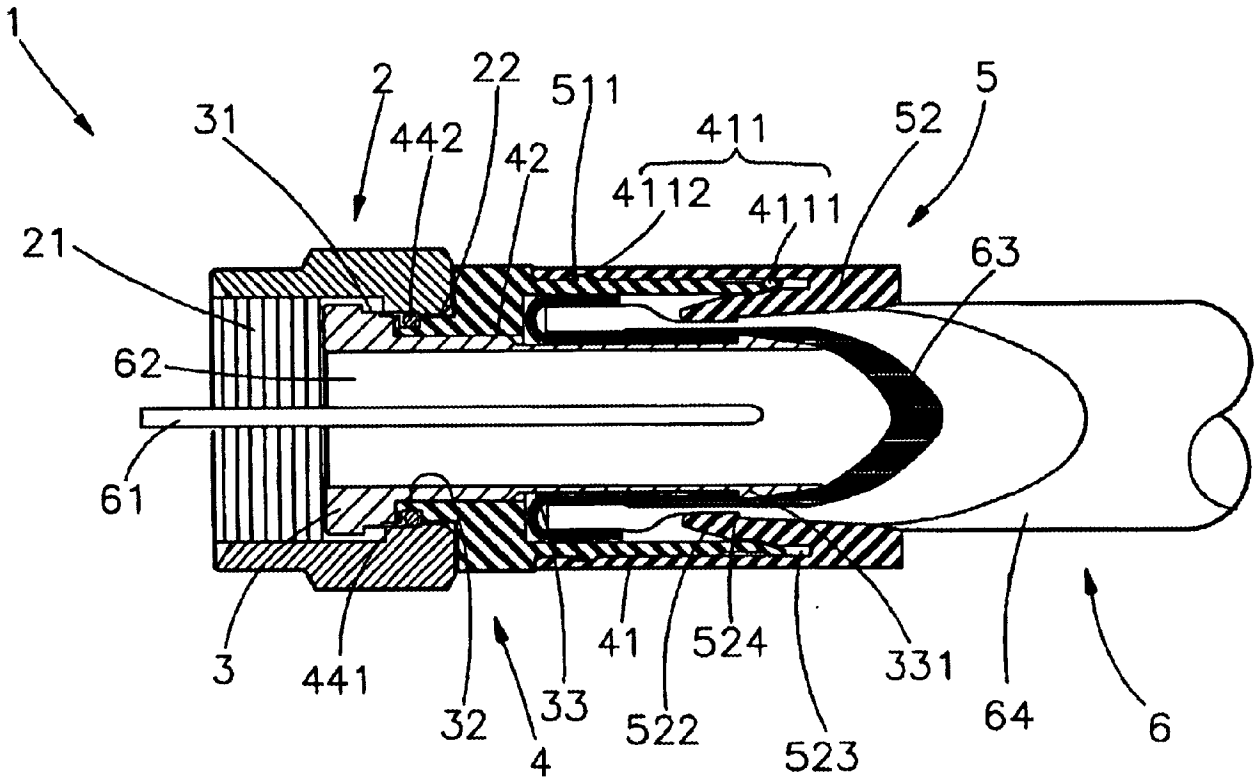
FIG. 7 is the sectional view of the signal adaptor according to another embodiment of the present invention.
Figure 8:
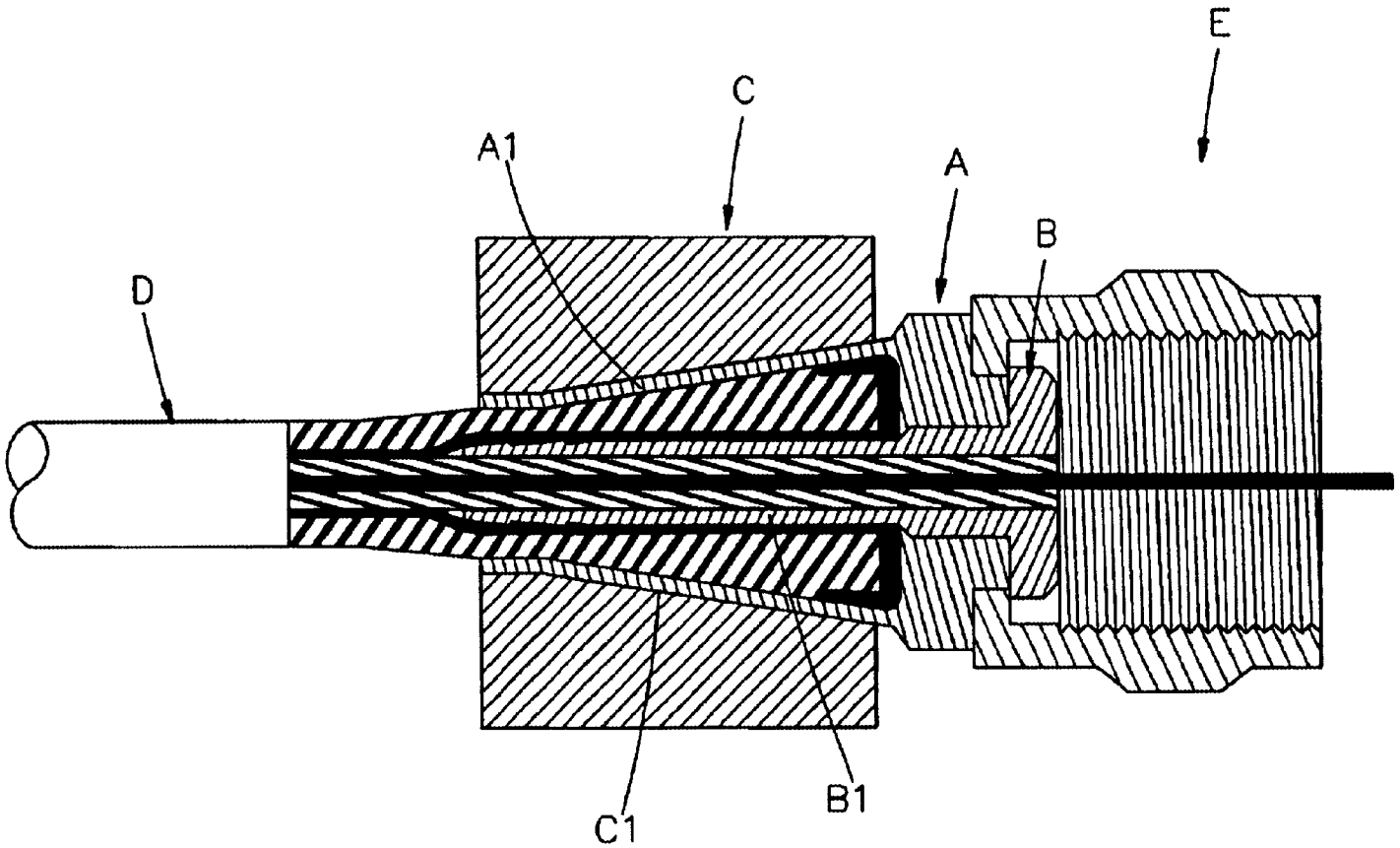
PRIOR ART FIG.8
FIG. 8 is a sectional view of a conventional signal adaptor.
Figure 9:
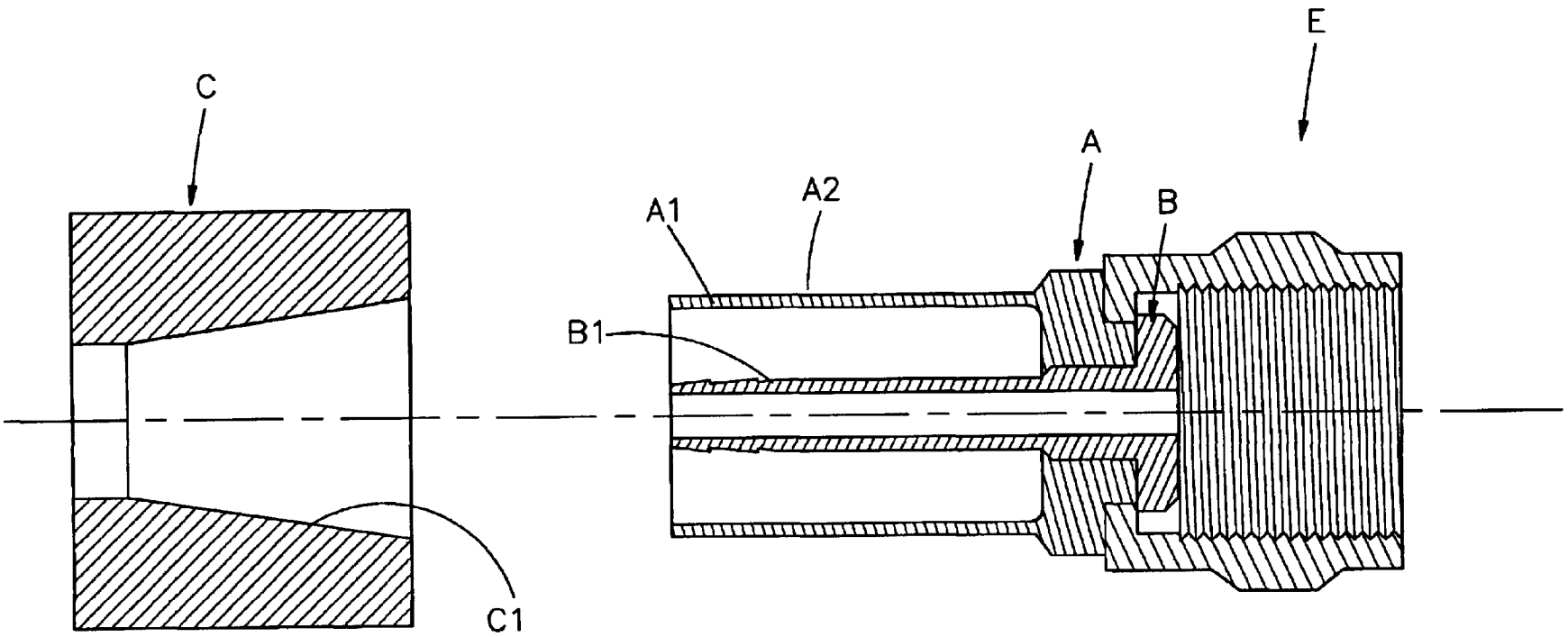
PRIOR ART FIG. 9
FIG. 9 is a sectional exploded view of the conventional signal adaptor.

And now refer to FIGS. 5 and 6 and 7 again, preferably, the positioning tube 5 is made of a rubber material because the rubber material has the advantage of being flexible as well as have a greater elasticity and therefore could be easily and securely accommodated within a given space. The securing element 52 within the receiving chamber 51 of the positioning tube 5 is integrally formed with the positioning tube 5 making the securing clement 52 elastic, thus when fitting the positioning tube 5 into the tubing element 4, the positioning tube 5 will be slightly extended to clamp with the tubing element 4 and in doing so, the securing element 52 gets elastically deformed under the influence of the pressing force of the covering hole 43 of the tubing element 4. Because the securing element 52 is elastic, therefore it will not get damaged when pushed by an external force. Further, this also allows the positioning tube 5 to securely clamp to the tubing element 4.

Furthermore, an inner buckle 524 is disposed in the central aperture 521 of the securing element 52 of the positioning tube 5, and a buckling circular groove 523 is formed on the outer side of the securing element 52. While fitting the signal wire 6 into the central aperture 521 of the securing element 52, the signal wire 6, the securing element 52 and the positioning tube 5 are pushed together onto the tubing element 4 so that the buckling circular groove 523 of the securing element 52 buckles with the slopping face 412 of the tubing element 4 and the securing element 52 gets elastically deformed as the signal wire 6 is continued to be pushed towards the central region until the inner buckle 524 of the securing element 52 buckles the sheath 64 of the signal wire 6. The isolation layer 62 and conductive wire 61 of the signal wire 6 is pressed into the buckling groove 34 of the fastening tube 3 in order for the buckling portion 331 of the fastening tube 3 and the inner buckle 524 of the securing element 52 to effectively clamp the signal wire 6. Thus the signal wire 6 and the positioning tube 5 are in close elastic contact with each other for both securing and sealing the signal adaptor 1 at the same time. Thus, the signal wire 6 cannot be easily dislodged under the external force.

The primary feature of the present invention is that a pad is positioned around the conjunctive portion at one end of the tubing element such that when fitting the tubing element and the fastening tube together forming the joint portion of the nut, the pad around the conjunctive portion seals the frontal and rear end of the signal adaptor providing waterproof effect. And the other end of the tubing element is for fitting within the positioning tube wherein the securing element is held and fastened securely.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A signal adaptor comprising:

a nut having a joint portion at one end, wherein said nut has an inner threading;

a fastening tube having a buckling groove, positioned within said nut, wherein said fastening tube comprises a supporting portion at one end and a tubing portion at the other end, and wherein a distal end of a rear side of said tubing portion is configured into an inclined awl shaped buckling portion;

a tubing element covering around said tubing portion of said fastening tube, wherein a frontal end of said tubing element comprises a conjunctive portion, and an outer flange of said conjunctive portion comprises a receiving circular groove, wherein said conjunctive portion has a receiving hole and is extendable for supporting a surface of said joint portion of said nut, and a rear portion of said receiving hole has a covering hole with larger dimension, and wherein said tubing element has a connecting portion outside of which has a buckling element; and a positioning tube covering around the tubing element, wherein said positioning tube comprises a receiving chamber and said receiving chamber comprises a securing element at one end integrally formed with said positioning tube and a positioning ring formed within the receiving chamber, wherein said securing element comprises a central aperture, and wherein said securing element is made of a rubber material.

2. The signal adaptor according to claim 1, wherein said tubing element comprises a receiving circular groove on said conjunctive portion for placing a pad.

3. The signal adaptor according to claim 1, wherein said tubing element is positioned around said fastening tube engaging with said conjunctive portion of tubing element and said tubing portion of fastening tube fits into said nut such that said pad held in said conjunctive portion of tubing element will come in contact with said joint portion of said nut.

4. The signal adaptor according to claim 1, wherein for connecting said nut with a connecting element of a signal wire, said connecting element is pushed within said tubing element so that said connecting forces said tubing element and said fastening element fitted within said nut such that the conjunctive portion and the joint portion come in contact with said pad at a multiple contact points for forming a tight joint between said conjunctive portion of tubing element and said joint portion of nut.

5. The signal adaptor according to claim 1, wherein said buckling element on said connecting portion of tubing element comprises a fixing ring and a buckling ring.

6. The signal adaptor according to claim 1, wherein said securing element of positioning tube has an inner buckle formed within said central aperture.

7. The signal adaptor according to claim 1, wherein said securing element formed inside said receiving chamber of positioning tube has an outer slopping face at an outer flange.

* * * * *